US006094901A

United States Patent [19]

Schermer et al.

[11] Patent Number: 6,094,901

[45] Date of Patent: Aug. 1, 2000

[54] PROCESS AND AN APPARATUS FOR THE PNEUMATIC CLEANING OF A THREAD WITHDRAWAL TUBE

[75] Inventors: Josef Schermer, Bergheim; Edmund Schuller, Ingolstadt, both of Germany

[73] Assignee: Rieter Ingolstadt Spinnereimaschinenbu AG, Ingolstadt, Germany

[21] Appl. No.: 09/072,942

[22] Filed: May 5, 1998

[30] Foreign Application Priority Data

May 5, 1997 [DE] Germany ..... 197 18 768

[51] Int. Cl.[7] ..... D01H 11/00

[52] U.S. Cl. ..... 57/304; 57/301; 57/415; 57/417

[58] Field of Search ..... 57/301, 304, 263, 57/305, 302, 406, 415, 417

[56] References Cited

U.S. PATENT DOCUMENTS

| | | | |
|---|---|---|---|
| 4,038,812 | 8/1977 | Stahlecker | 57/56 |
| 4,069,654 | 1/1978 | Roehrich | 57/302 |
| 4,665,687 | 5/1987 | Ott et al. | 57/415 |
| 4,829,762 | 5/1989 | Wassenhoven | 57/417 |
| 4,843,812 | 7/1989 | Raasch | 57/417 |
| 5,044,151 | 9/1991 | Pohn et al. | 57/417 |

FOREIGN PATENT DOCUMENTS

| | | | |
|---|---|---|---|
| 296412 | 12/1988 | European Pat. Off. | 57/417 |
| 2909253 | 9/1980 | Germany . | |
| 3723504A1 | 1/1989 | Germany . | |
| 19624537 | 6/1996 | Germany . | |

OTHER PUBLICATIONS

German Patent Office Search Report, Jul. 23, 1997.

*Primary Examiner*—William Stryjewski
*Attorney, Agent, or Firm*—Dority & Manning

[57] ABSTRACT

The present invention concerns a process and an apparatus, in particular a rotor cover (3) and a thread withdrawal tube (2), of an open-end spinning machine, for the pneumatic cleaning of the thread withdrawal tube (2) which has an irregular inner contour. In this arrangement, there opens into the zone of the irregular contour (24, 220) of the thread withdrawal tube (2) an air feed tube (6, 60) directed against the irregular interior contour (24, 200) into the inner space (25) of the thread withdrawal rube (2), through which a flow of air is conducted against the irregular inner contour (24, 220) of the thread withdrawal tube (2). The irregular inner contour (24) of the thread withdrawal tube (2) is formed by means of a disassembly point between two thread guiding elements (20, 21, 22, 23) arranged in sequence, the elements making up the complete thread withdrawal tube (2) or a twist element (220).

16 Claims, 2 Drawing Sheets

PROCESS AND AN APPARATUS FOR THE PNEUMATIC CLEANING OF A THREAD WITHDRAWAL TUBE

BACKGROUND OF THE INVENTION

The present invention concerns a process for pneumatic cleaning of a thread withdrawal tube, and also concerns an apparatus, and especially a rotor cover and a thread withdrawal tube which are essential to the execution of said process.

For the cleaning of the exit area of the thread withdrawal tube, it is common knowledge to place a suction or compressed air jet (DE 29 09 253 A1) in said exit area. In this way, it is indeed possible, to clean the outer end area of the thread withdrawal tube, and when such a device is installed on that side of the spinning apparatus assembly which faces the thread withdrawal tube, even the interior zone of the end thereof is cleaned. The interior zone of the thread withdrawal tube, which binds together these two end areas is then only unsatisfactorily cleaned, especially considering the normally complex interior shaping of thread withdrawal tubes of this kind.

OBJECTS AND SUMMARY OF THE INVENTION

Thus a principal object of the present invention is the creation of a process and an apparatus, in particular the creation of a rotor cover or a thread withdrawal tube, which lend themselves to a simple, basic and assured cleaning in a very simple way particularly in the most endangered zones of the interior spaces of the thread withdrawal tube. Additional objects and advantages of the invention will be set forth in part in the following description, or may be obvious from the description, or may be learned through practice of the invention.

The purposes will be achieved, in accord with the invention, through the features of the invention wherein an air flow is directed against the irregular interior contour within the interior space of said thread withdrawal tube. The cleaning air flow, in this manner, flows through the thread withdrawal tube not only in an axial direction, but is also directed by a radial component into the interior space of the said thread withdrawal tube to those locations where fiber and dirt particulate agglomerate on the exposed surface, and said air flow loosens the resulting deposits from the endangered zones. The said endangered zones are defined as the gap between certain elements of the thread withdrawal tube, or again as the element possessing an inside spiral configuration of ribs within the thread withdrawal tube, i.e. a spiral element. The purpose of such baffles is to impart to the air flow a forward rotary motion.

Another area classified as so endangered is a sudden change in effective inside diameter of the said thread withdrawal tube.

Independent of the arrangement of the spiral elements being at the entry of the thread withdrawal tube, at the exit thereof, or in between, the spiral shaped design of the area of this spiral element coming into contact with the thread is of value, when in further design of the process in accord with the invention, a rotary, forward motion component is imparted to the air flow essentially in the direction of said spiral shaped profiling.

As a rule, the spiral element, or the like, exhibits interior ribs which are in spiral configuration. A separation place between two sequentially following thread guiding elements of the thread withdrawal tube is a linear continuation in the circumferential direction of the thread withdrawal tube, essentially contributing toward the extension of length of the same. In both cases, a development of the process, in accord with the invention wherein the air flows essentially tangentially in the interior space of the thread withdraw tube, leads to the conclusion that the incoming air flow travels through the said endangered area and thereby performs a cleaning function, whereby an optimal cleaning action is achieved.

In order that the scoured away dirt particulate and fiber residuals are transported out of the thread withdrawal tube, to be immediately—or at a given time—brought in the area of activity of an air flow and thus removed, it becomes a practical matter if the process is improved in accord with the invention wherein the flow of air is imparted a directional component against the inside of the open-end spinning apparatus.

Principally, it can suffice, if the air flow for the cleaning of the said gap, is generated by the spinning apparatus suction, so that this flow of air is continually present, as long as in the open-end spinning apparatus, a suction holds forth.

It is advantageous, however, if an air flow is not introduced into the thread withdrawal tube during the entire spinning process, but mainly to determine, appropriate cleaning periods ahead of time. For instance, these would occur during interruption events of the spinning process or at certain time periods when the spinning operation would not be disturbed. Upon these grounds, the process, in accord with the invention, is developed so that the air flow is controlled.

In order to remove dirt materials and fiber residuals from the mentioned gap or from the inner spiral profiling of the thread withdrawal tube, it is purposeful if the process is further developed, in accord with the invention, so that air flow is introduced into the thread withdrawal tube, while, on the end of the thread withdrawal tube facing the open-end spinning apparatus, a suction is applied.

The suction, which is brought to bear on the end of the thread withdrawal tube, which end is facing the open-end spinning apparatus, can be generated in various ways. For instance, this could be carried out with the help of a suction producing source available at this end of the thread withdrawal tube.

It may be preferable to avoid an additional suction apparatus of this kind. In this case, the suction which is in force during the normal spinning process is made effective, or is allowed to remain in force, while the air flow is conducted into the interior of the thread withdrawal tube so that the effective suction of the entire spinning process is used for the removal of loosened deposits, fiber agglomerations, or dirt accumulations. This respective suction is independent of the design of the open-end spinning apparatus whether this is constructed as an air spinning system, or a friction spinning system, or yet as a spin rotor. This suction, further, is effective throughout the entire spinning process in order to generate a tension in the thread, without which, in any case, spinning would be impossible. What is achieved thereby, through the development of the process, in accord with the invention, is that in the case of an open-end spinning apparatus designed on a rotor spinning principle, the spinning suction for the removal of the loosened materials from the interior surface thread withdrawal tube is put to use in a remarkably effective manner.

A simplification of the control for the combined cleaning of the thread withdrawal tube and the open-end spinning apparatus, is allowed by a development of the process wherein the air supply into the interior space of the thread withdrawal tube is released at the same time as the open-end spinning apparatus is subjected to a pneumatic cleaning, since in this case as well as for the cleaning of the interior of the thread withdrawal tube and the open-end spinning apparatus, one common control command suffices.

In accord with the invention, before the cleaning phase, in which the air flow is conducted into the interior of the thread withdrawal tube when the rotor cover is closed, another cleaning phase is provided, in which the rotor cover is held in its opening position and a high velocity air jet is introduced over the open rim of the spin rotor for the purpose of cleaning said rotor, while the air flow for the cleaning of the thread withdrawal tube is conducted out of said withdrawal tube into the spin rotor in such a manner, that an air flow arises directed from the interior of the spin rotor against the open rim of said spin rotor. This is an improvement of the process, since in this way, the established suction for the removal of the loosened dirt and fiber residuals can be put to alternate or additional use.

More expediently, the cleaning of the thread withdrawal tube can be accomplished wherein the air supply introduction into the interior of the thread withdrawal tube is undertaken during the reinsertion of the end of a thread into the open-end spinning apparatus for spinning start-up, since in this way, without a repetitive switching on and off of the spinning suction for economical or time saving reasons, the required suction for the start of spinning and for the removal of the loosened, undesirable contamination or fiber residuals from the thread withdrawal tube can be put to use.

It is advantageous, if, for the cleaning of the gap, or the spiral element, an intensive air flow is available, which furthermore can reach the endangered locations at full power. For this purpose, a design of the process wherein the air flow is introduced into the interior of the thread withdrawal tube as a compressed air flow has proven itself as especially effective. In this respect, an intensification of the cleaning efficiency can be achieved if the air flow injected into the interior of the thread withdrawal tube is a pulsated flow.

For the accomplishment of the previously stated purposes, and in accord with the invention, an apparatus is provided wherein in the zone of the irregular interior contour of the thread withdrawal tube, an air supply conduit directed against the irregular interior contour opens into the interior of the thread withdrawal tube by means of which dirt particulate, fibers and fiber residuals, which have settled and agglomerated, most likely, on the irregular interior contour of the thread withdrawal tube, can be removed therefrom. The irregular interior contour of the thread withdrawal tube is formed by a gap between a thread guiding element and the sequentially placed thread guiding elements of the thread withdrawal tube. Regarding the irregular interior contour of the thread withdrawal tube which is to be cleaned, this can involve a separation, which is designed as a gap between the thread guiding element and the sequentially placed thread guiding elements of the thread withdrawal tube, and said gap exhibiting a breadth which is greater than the largest diameter of the fibers which are entering to be spun.

By these means, the risk is held as low as possible, that dirt, scale particulate, fibers or fiber residuals deposit and agglomerate here.

Such deposits or buildups of fiber and dirt particulate do not only form on the mentioned gap, between two neighboring elements of the thread withdrawal tube, but also on the inner, spiral element, which was especially profiled to impart a rotational twist and exercises a powerful effect on the thread which finds itself in contact therewith during withdrawal. Thus, contamination and fiber components here split off from threads and deposit at this point. Based on these grounds, advantageously, an air supply line was directed in accord with an apparatus wherein the irregular interior contour of the thread withdrawal tube is formed by a spiral element.

Because of the internal spiral shaped design of the spiral element which comes into contact with the thread in the thread withdrawal tube, it is advantageously independent of the arrangement of the thread withdrawal tube, if, in a further development of the invention, the air supply is oriented as a continuation of the said spiral shaped profiling.

An optimal cleaning of the spiral element and/or the separation position between neighboring elements of the thread withdrawal tube is brought about by the improvement wherein the common air supply line is oriented essentially tangentially to the inner space of the thread withdrawal tube.

In order to transport the loosened fiber and dirt particulate from the interior wall of the thread withdrawal tube in a simple manner out of said interior of said thread withdrawal tube to be able to immediately remove it, a further improvement of the apparatus in accord with the invention wherein the common air supply line possesses a directional component against the interior of the open-end spinning apparatus is of advantage. The orientation of the air flow in the direction of the open-end spinning apparatus can be achieved in an advantageous embodiment by the design of a thread carrying element of the thread withdrawal tube located at a greater distance from the open-end spinning apparatus possesses on its outer circumference a chamfer, against which the air supply line is directed.

Principally, the cleaning airflow can be active throughout the entire operation of the open-end spinning apparatus. However, for technical reasons, as well as for the saving of air, a design wherein the air supply lines include a valve which is also connected to a control device is particularly advantageous, wherein the airflow is allowed to be active at only certain times.

In order to be able to reliably remove the loosened components from the inner wall, that is, from about the gap and/or from the spiral element, during the cleaning of the thread withdrawal tube, it is advisable to install the apparatus wherein the control device assigned to the air supply line is connected to an apparatus for the generation of suction on that side of the thread withdrawal tube facing the open-end spinning apparatus. Also in accord with the invention, the apparatus for the generation of suction on that side of the thread withdrawal tube facing the open-end spinning apparatus is designed for the generation of a spinning suction in the open-end spinning apparatus by means of the said apparatus. In the case of an open-end spinning apparatus which possesses a spin rotor with a fiber collection grooving and a spin rotor cover which can be activated by a controllable drive mechanism and in which the thread withdrawal tube is at least partially included, the drive mechanism of the rotor cover is controllably connected with the control device for the valve in the air supply.

Advantageously, the control device for the control of the valve for the cleaning of the thread withdrawal tube is controllably connected to an additional control device for a pneumatic cleaning device for the open-end spinning apparatus or is connected with such a control device. The rotor cover with the aid of the control device can be brought into such an open position, for situating the pneumatic cleaning conduit of the open-end spinning apparatus, that an air flow to clean the rotor, issuing from said cleaning conduit provided in the rotor cover, is directed over the open rim of the spin rotor and, further, an air flow for the cleaning of the thread withdrawal tube reaches the interior of the spin rotor in the zone of the base thereof, i.e. between the base and the fiber collection grooving. The control device assigned to the air supply line can be a component of a control device for the start-up of the open end spinning apparatus, or is connected to such a control device.

A control for the purpose of an especially effective cleaning can be constructed wherein the air supply line is connected to a pressurized air source, and in that in the air supply line, a valve is provided for the supply of a pulsating air flow.

A development of the invention wherein an air passage conduit in the rotor cover is in connection with the air supply line in the thread withdrawing tube eases the simultaneous or later connection to an air supply line and/or a cleaning conduit for the cleaning of an open-end spinning apparatus which possesses a spin rotor.

In a simple and effective way, the present invention permits not only a cleaning of the section of the thread withdrawal tube which finds itself in the area of an air flow moving axially therethrough, wherein this said air flow, in any case, is continually available during the operation of the spinning operation on the grounds of the governing spin-suction and shows little effect, but enables, in particular, a cleaning of the especially endangered areas inside the thread withdrawal tube. In these areas, the concern is about the irregular contours of the interior space of the thread withdrawal tube. These may be irregular contour of any kind, for instance, a particularly abrupt change of diameter, a gap between two thread bearing elements which follow one another sequentially in the direction of the withdrawal, as well as the spiral element. This spiral element can be installed in the entrance area of the thread withdrawal tube, or in the exit area thereof, or anyplace in between the two given areas.

These areas are located, fully, or at least partially, outside of the passage of the thread to be withdrawn so that this thread is not situated during its withdrawal to carry away dirt or other disturbing components, which could have accumulated here and firmly set as a deposit. Also, the prevailing suction for the open-end spinning apparatus, which is present during normal spinning operation, cannot exert itself in these areas, or only in an insufficient manner. The result of this is that the cleaning effectiveness of said suction does not suffice for the removal of the said deposits and fiber and dirt accumulations. Moreover, the danger arises that large quantities can even lockingly bond to the surface. Because of the process and the apparatus in accord with the present invention, the cleaning air flow is turned exactly into the named areas, so that even under the most difficult circumstances an assured and consummate exclusion of such undesirable components is assured.

The apparatus does not require a large installation area and allows small dimensioning for itself even in the case of rotor spinning apparatus and the modern rotor covers customary there. Compliant with the design of the apparatus for pneumatic cleaning of a thread withdrawal tube, changes relative to the state of the technology limit themselves to those changes which are necessary in order to carry through the process in accord with the invention. Such changes may be:

to the thread withdrawal tube alone, to the thread withdrawal tube and the thread withdrawal carrying rotor cover.

By a coupling of the cleaning of the thread withdrawal tube to a cleaning of the open-end spinning apparatus, only a few control related connections are required, so that even a retrofit of available open-end spinning apparatus with the apparatus in accord with the invention for executing the process in accord with the invention is possible with very little material and time expenditures.

BRIEF DESCRIPTION OF THE DRAWINGS

Example embodiments of the invention are described in detail in the following with the aid of drawings. There is shown in.

DETAILED DESCRIPTION

Figure 1:
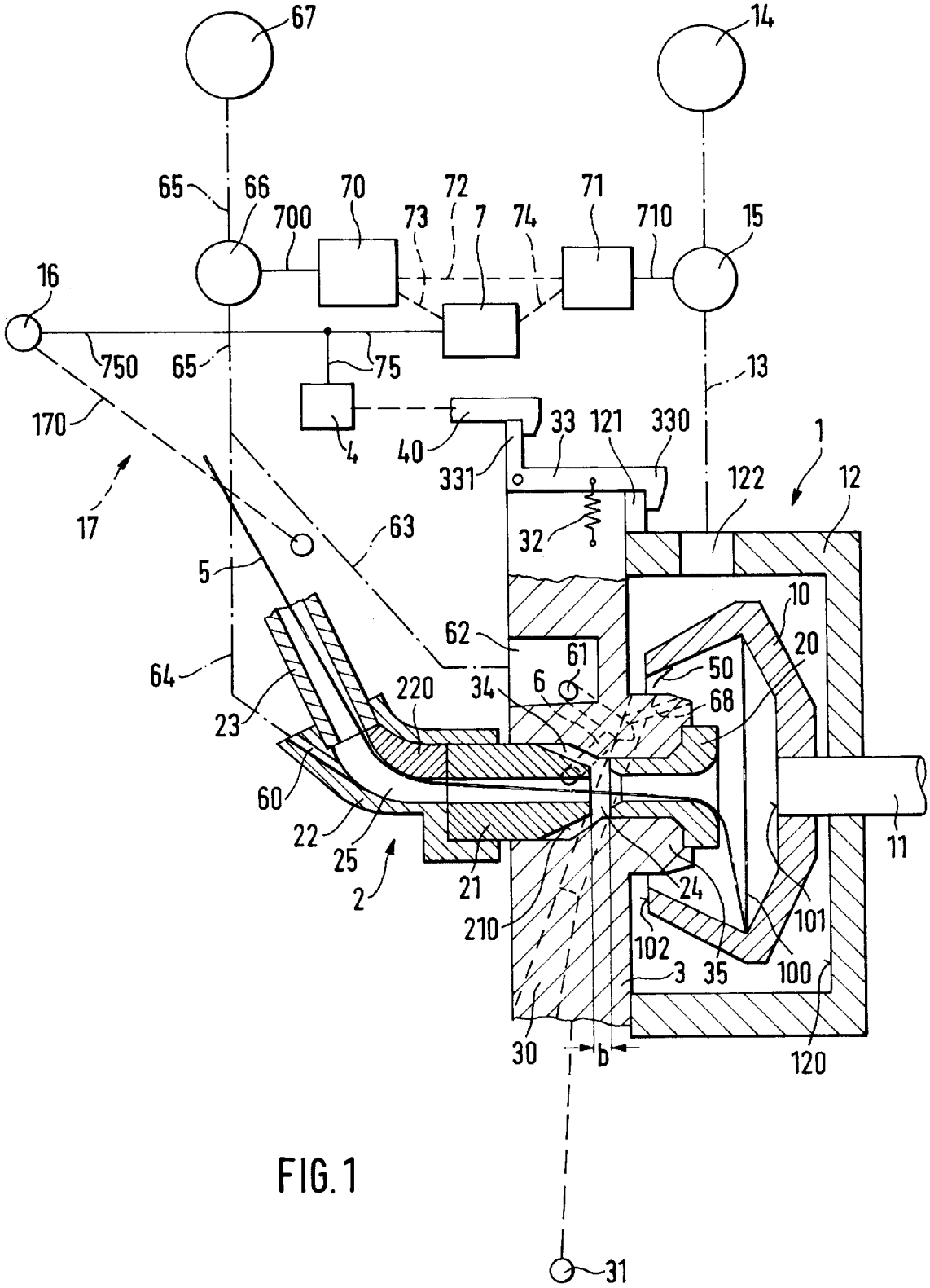
FIG. 1 a section through an open-end spinning apparatus designed in accord with the invention and FIG. 2 a section of a detail of a thread withdrawal tube modified in accord with the present invention.

Reference will now be made in detail to the presently preferred embodiments of the invention, one or more examples of which are illustrated in the drawings. Each example is provided for way of explanation of the invention, and not as a limitation of the invention. For example, features illustrated or described as part of one embodiment may be used with another embodiment to yield still a third embodiment. It is intended that the present invention include such modifications and variations.

The process and the apparatus in accord with the invention allows that usage may be made of various kinds of open-end spinning apparatus (1), for instance, friction spinning apparatuses, air spinning apparatus, electrostatic open-end spinning apparatus and the like. FIG. 1 shows, as an example embodiment, an open end spinning apparatus designed with a rotor spinning device. In the case of all the named open-end spinning apparatuses 1, a spun thread 5, with the aid of a (not shown) withdrawal device, is taken out by means of a thread withdrawal tube 2 and guided to spooling on a (not shown) spool apparatus. The thread withdrawal tube 2 possesses, as a rule, a complex, that is, irregular interior contour, which influences the twisting, i.e. especially enhances the forward progressing, rotary motion of the thread.

The rotor spinning device shown in FIG. 1, possesses in a conventional way, a spinning rotor as a spin element, which can be designed in the usual manner. The spin rotor 10 is carried on a shaft 11, which is driven by a drive means which is not depicted. The spin rotor possesses a fiber collection grooving 100 for the seizing of the fibers 50, which are fed into the device in separated form through a conventional fiber feed conduit 30. Beyond this, the spin rotor possesses a base 101 situated opposite from the said thread withdrawal tube 2 and has also, on the side facing and in proximity to the thread withdrawal tube 2, an open rim 102.

The spin rotor 10 is disposed in a housing 12, through the base 120 of which the shaft 11 of the spin rotor 10 extends, wherein the penetration opening is sealed in a manner not shown. On the side of the housing 12 facing the thread withdrawal tube 2, the said housing 12 which holds the spin rotor 10 is covered by a rotor cover 3. This cover,—as will be explained in more detail later—in spite of the shown latching, can have an "open" position.

Both the fiber feed conduit 30 and the thread withdrawal tube 2 are carried by the said rotor cover 3, wherein these two connections penetrate the said rotor cover 3.

As schematically indicated in FIG. 1, the rotor cover 3 is pivotally fixed about an axis 31, so that it can be swung away from the housing 12 in order to expose an open side of the housing 12 and especially an open side of spin rotor 10. In order that the rotor cover 3 can be brought out of its latched position into its open position, and then brought back again, it possesses a catching pawl 33 which is loaded by a spring 32, or the like, the end 330 of which pawl 30 can snap in behind a provided detent 121 on the housing 12. The other end 331 of said pawl 330 can be so swivelled by an activation lever 40, so that it lifts itself first from the said detent 121 and then, by means of its open swinging movement initiated by the activation lever 40, takes the rotor cover 3 with it into its open position, and later, back into its locked position. Further comment will be made in regard to a more detailed explanation of the control of this activation lever 40 and its drive mechanism 4.

The thread withdrawal tube 2, which is installed coaxially to the spin rotor 10 on the rotor cover 3, is multi-sectional, that is, it is comprised of several thread carrying elements, namely 20, 21, 22 and 23. These elements 20 to 23, or some thereof, can be encapsulated in an additional, sheath-like element so that, in case of need, a group of individual elements 20 to 23 of the thread withdrawal tube 2 can always be replaced as one unit.

In the case of the example embodiment shown in FIG. 1, the elements 21 to 23 are connected one to the other and thus consolidated into one construction unit, which can be replaced in its entirety. Of the above sequential elements 21 to 23, which are found in the withdrawal direction, input nozzle element 20 must be exchanged fairly frequently for the achievement of different effects in yarn such as softer or harder twists or an increase of the air rotation to enhance the strength of thread during withdrawal, etc. This exchange is in favor of an element 20 of different shape. Therefore, this element 20, which, as mentioned, is an input nozzle, is installed separately from the elements 21 to 23 in the rotor cover 3 and is removable. This element 20 can, in conventional ways, possess notches, fillets, etc., that is to say, exhibit areas of varying roughness in which these, again in consideration of their shape, size and arrangement differ from one another.

Figure 2:
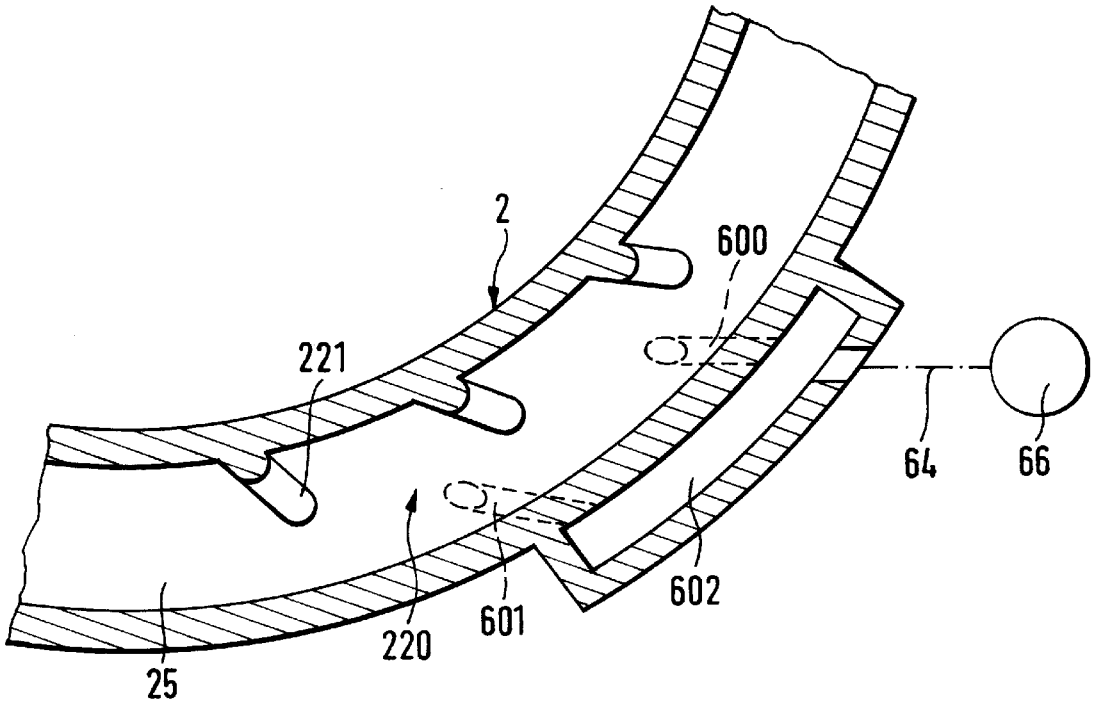

The element 21, which, in the direction of the thread withdrawal, follows element 20, serves principally for the guidance of the thread 5. Element 22, which follows element 21, again in the withdrawal direction, is the element containing the internal spiral ribbing 220, in order to impart to the thread being withdrawn a desired twist, so that the withdrawing strength of the thread in any case is increased. This spiral element 220 can be designed in the conventional manner and be provided with notches, webs and the like. An example embodiment described in detail by FIG. 2 is provided. The final section of the thread withdrawal tube 2, in the direction of the withdrawal, is the element 23 which is in the shape of a simple, straight piece of tubing, in some instances, possibly conformingly curved.

The gap 24, which is made by the separation between the sequential elements 20 and 21, as well as the spiral element 220 (see FIG. 2) form an irregular zone in the interior of the inside contour of the thread withdrawal tube 2. It is in this zone that the danger exists that dirt particles as well as fiber and scale residuals, the latter having been released by the sliding of the thread 5 against the inner contour of the thread withdrawal tube 2, will collect and in some cases wedge themselves into a hard deposit.

In order to avoid this danger, in accord with FIG. 1, an air supply line 6, which is essentially tangentially aligned in the area of this gap 24, opens into the interior space 25 and a further air supply 60 is also provided as well. Air supply 60 opens in the area of the spiral element 220 in the thread withdrawal tube 2, and is directed in flow against the irregular interior contour of the thread withdrawal tube 2, here the irregularity being the spiral element 220. The air supply line 6 branches away from an air supply line 61, which in turn finds its origin in a bored recess 62 in the rotor cover 3, which recess is intended for a connection to a compressed airline 63.

The compressed air line 63, as well as a further compressed air line 64 which serves air supply line 60, both join at a common supply line 65, in which a valve 66 is provided. The common air supply line 65 has its origin in a compressed air source 67.

Besides the air supply line 6, there branches off from the air supply conduit a cleaning conduit 68, which is fed from the same compressed air source 67 as the air supply lines 6 and 60.

The previously discussed housing 12 exhibits a connection opening 122 for connection to a suction line 13, which in turn communicates with a suction source 14 and in which said line 13 a valve 15 is provided.

Each of the two valves 66, 15 is assigned to interconnected control devices 70, 71 by control line 700, 710, all in respective order. These control devices are, functionwise, synchronized with one another (see the dotted control interconnections 72 of FIG. 1.) Also, a control device 7 is provided for the regulation of the drive apparatus 4 (see control line 75), which can likewise be controllably interconnected with the other control devices 70 and 71 (see the dotted control connections 73 and 74). The control device 7, in accord with FIG. 1, is moreover in communication with a drive 16 for a thread reinsertion device 17 (by control line 750), which device 17 exhibits a pivotable thread discharge yoke 170 of a conventional type of construction.

During the operation of entire spinning process, the spun thread 5 running through the spin rotor 10 is withdrawn through the thread withdrawal tube 2. By means of the turning and contact surfaces which, as a general rule, are surfaces of special design, which belong to the element 20, the thread 5 is strongly stressed, so that short fiber components from the thread center spring outwardly and can remain deposited on one of the following irregular surfaces or areas of the complex interior contour of the thread withdrawal tube 2, including gap 24 and the spiral element 220, which areas extend themselves beyond the limits of the thread passage of this zone. In order to once again free these thread residuals, dirt components, scale particles, etc. from the cited places, through the air supply line 6, a jet of air from compressed air source 67 is directed into the gap 24, which jet assuredly and quickly removes the said undesirable deposits. This effect can still be intensified, in that the compressed air jet is introduced not as a single, more or less long reaching blast of air into the interior of the thread withdrawal tube 2, but in that the compressed air jet is blown in a pulsating manner into the said gap 24. The intermittent release and interruption of the compressed air jet can, of itself, in a known manner and way, be achieved by appropriate control of the valve 66.

By the indicated, essentially tangential air input into the space 25 of the thread withdrawal tube 2, the inlet air covers over the entire internal circumferential area of the gap 24, which strongly reinforces the cleaning action.

Since the housing 12 is in communication with a source of suction 14 with the help of the valve 15, then the suction line 13 for the removal of the loosened deposits can be thus attached. By means of the suction source 14, in the housing 12 a suction is generated, which, of itself, creates in the thread withdrawal tube 2, an air flow directed against the interior of the spin rotor 10. In order to ease the removal of the loosened deposits out of the thread withdrawal tube 2, it has been provided, as shown in FIG. 1, that to the air flow entering into the gap 24, a movement component is imparted in the direction of the open-end spinning apparatus 1—that is, spin rotor 10—while the air supply line 6 and/or 60 projects a directed component oriented toward the open end spinning apparatus 1.

For reasons based on fabrication technology, the installation of the air supply line 6 in the desired direction is problematical, that is, it can be difficult to carry out. In spite of the foregoing, in order to still achieve a desirable orientation of the air supply line 6, which exhibits a directional component against the spin rotor, the thread guiding element 21 possesses an outer contour (chamfer 210) which narrows itself toward the element 20. In this respect, it is to be considered that element 21 is, in the direction of the thread withdrawal, next in sequenced position to the gap 24, thus at a greater distance from the open-end spinning apparatus than is the thread guiding element 20 which is first in sequential position and borders on the gap 24. The flow of air, which is led against this chamfer 210, i.e. against the outer, tapering circumferential area of the element 21, is therefrom diverted in such a manner that it receives a motion component in the direction of the spin rotor 10. Furthermore, the outer border limits of the gap 24 lie between a recess 34 in the rotor cover 3 which receives element 21 of the thread withdrawal tube 2 and the chamfer 210, which recess then tapers in a direction toward the spin rotor 10, so that the intensity of the air flow reaching into the gap 24 is not, or essentially not, diminished.

In an analogous manner, an air flow, with the help of the air supply line 60, is directed against the spiral element 220, which element 220 forms an irregular interior contour of the thread withdrawal tube 2. The spiral element 220 produces, in a conventional way, a rotation in the air flow by means of appropriate internal profiling 221 (see FIG. 2) or the like. Between the spiral ribs, deposits can agglomerate, which are not touched by the thread 5 which is in the process of withdrawal. Therefore, the deposits are neither prevented from forming, nor are they removed. The air line 60, as well as the air line 6, can show a directional component not only against the spiral element 220, but also against the open-end spinning apparatus 1 which holds the spin rotor 10.

The simultaneous release of the two air flows, which leave from the air lines 6 and 60, is accomplished with the help of the valve 66 which is under the regulation of the control device 70.

For the air supply lines 6 and 60, on the one hand, and the cleaning conduit 68 on the other, separate supply lines 64—provided with separate valves 66—for the control of the cleaning air flow for the cleaning of first, the thread withdrawal tube 2 and second, the cleaning of the spin rotor 10 (or a spin element of another kind). Thus, the control devices assigned to these valves are controllably connected one to the other, that is, they form a single unit, in order to coordinate the cleaning operations.

Since, in accord with the illustrated embodiment of FIG. 1, compressed air flows from one source constantly serve both for the rotor cleaning as well as for the cleaning of the deposit endangered zones of the thread withdrawal tube 2, these compressed air flows branch, as described above, from a common line 65 and are both regulated in the same manner by the control device 70 through the valve 66.

In the case of the rotor cleaning, the first step involves the removal of a fiber ring (not shown) from spin rotor 10, which was left there as a result of a thread break. This removal has to be accomplished before the fiber collection grooving 100 can be cleaned. This removal is done as follows. By means of the control device 7, the drive mechanism 4 for the opening of the rotor cover 3 is activated. The control device 7 is controllably connected to the control device 70 for the regulation of the compressed air flows in the air supply lines 6 and/or 60, which remain in connection with the air feed conduit 68. The drive means 4 is activated for the opening of the rotor cover 3, which said drive, after the unlocking of the rotor cover 3, pivots this cover so far that the air issuing from the assumed extension of the cleaning conduit 68 (the rotor cleaning air flow) now blows directly over the open rim 102 of the spin rotor 10. The cleaning air conduit 68 is, in this opened up position of the cover 3, predominately oriented to point to the connection opening 122 and the rotor cleaning air flow issuing from this cleaning conduit 68 blows directly against the fiber ring of this connection opening 122. During this action, the exterior wall of the shoulder 35 of the cover 3 facing away from the connection opening 122 is tilted opposite to the direction of removal of the fiber ring, so that this slips out easily from underneath this cover shoulder 35 and also from under the element 20 which projects slightly over said cover shoulder 35. As this is carried out, support is given to the removal of the said fiber ring by the air flow conducted to the thread removal tube 2 through the air supply lines 6 and 60 in the following manner. The said air flow reaches the spin rotor 10 in the area of its base 101, or between the base 101 and the fiber collection grooving so that the air flow turns back in the direction of the open rim 102 of the spin rotor 10, thus, as above, supporting the removal of the fiber ring.

Likewise, the compressed air leaving the cleaning conduit 68 supports also the removal of the air flow out of the thread withdrawal tube 2. After a short time, the fiber ring is removed from the interior of the housing 12.

Subsequently, the rotor cover closes itself, by action of the control of the control device 7, while the compressed air flow in the air supply lines 6 and 60 remain operational as well as in the cleaning conduit 68. Since now no more air can be sucked in between the housing 12 and the rotor cover 3, all the air, which leaves the housing 12 through the suction opening 13, enters through both the cleaning conduit 68 as well as the thread withdrawal tube 2 into the interior of the housing 12. By this means, the thread withdrawal tube 2 is not only purged with air, which enters it through air supply lines 6 and 60, but in addition, ambient air is pulled out by suction through the rotor spinning apparatus 10, connection 122, and this flows through the thread withdrawal tube 2 in an axial direction, and at the same time takes care that deposits, which by means of the two directed compressed air flows in the said thread withdrawal tube 2, were removed from the interior contour of this thread withdrawal tube 2, are picked up by the said axial air flow now passing through the thread withdrawal tube 2 and, passing through the spin rotor 10, are carried out through the connection opening 122.

Because of the axial air flow through the thread withdrawal tube 2 acting in the direction of the spin rotor 10, which flows during the cleaning of the said thread withdrawal tube 2, is especially intensive, at the outer outlet opening of the element 23 there is in force a strong air flow directed to the interior of the thread withdrawal tube 2, which flow can be made use of to pull an end of a thread into the thread withdrawal tube 2 during a spinning startup.

The end of the thread, in this circumstance, remains in readiness so that finally and at an appropriate time, it can be fully released to take part in the ensuing steps of a spinning startup procedure by being cast off by the thread discharge yoke 170. In this way, the end of the thread can be inserted into the fiber collection grooving of the spin rotor 10. Thus, it is useful if the supply of an air flow into the interior of the thread withdrawal tube 2 for the purpose of cleaning the same is carried out. From a time saving standpoint, it is at least efficient to do this during the reinsertion of the thread 5 into the thread withdrawal tube 2 or into the open-end spinning apparatus.

As the foregoing description indicates, the rotor cleaning, the cleaning of the withdrawal tube 2, and also the spinning start-up as well as the reinsertion of the end of the thread into the withdrawal tube 2 and from there into the fiber collection grooving 100, can all be carried out in very short, sequential time periods, and can all be worked into one and the same program. In such a case it is favorable, if the single control devices 7, 70 and 71 are not only controllably coupled with one another, but coalesced together into a single control system (not shown), in order to carry out all the said cleaning and other program steps during a spinning start-up.

FIG. 1 shows a rotor spinning apparatus 1, which combines many inventive features in it. It is understood that the invention is not limited to a single design of an open-end spinning apparatus, but can be subject to change through multiple combinations of the inventive features such as the substitution of certain features for equivalents. Thus, it is not unconditionally a requirement that an air flow enters the withdrawal tube 2 at various positions, but in accord with the respective design of the endangered locations. In accord with the arrangement of the entry ports, one or more air supply lines 6 and/or 60 can suffice, if not every one of these endangered locations has its own air supply line 6 and/or 60 assigned to it. Moreover, through appropriate dimensioning of the gap 24 and/or the spiral element 220 it may also be achieved that at least the danger of block-up by fibers, fiber scales, and residuals can be reduced. Thus it is advantageous to note how the embodiment example of FIG. 1 shows why the gap 24 is not too finely dimensioned. If the gap 24 possesses a breadth b, which is greater than the maximal diameter of the fibers 50 to be spun which reach it, then these fibers cannot hang up in the gap 24, but generally collect loosely. Since the fibers 50 have a very small cross section, which measures only about a hundredth of a millimeter, the breadth of the gap 24 can be between 0.1 and 0.5 mm, or possibly somewhat smaller or greater.

It was described previously, that the cleaning of the withdrawal tube 2 as well as the cleaning of the spin rotor 10 can be carried out in common. Even this is not a necessary presupposition for the described apparatus.

If, for instance, the cleaning of the spin rotor (10) is undertaken with the help of a mechanical element (not shown), or could such a cleaning of the spin rotor not be done simultaneously with a cleaning of the withdrawal tube 2, then these two cleaning procedures can be separated from one another physically and time-wise. Furthermore, the loosened deposit material removed by an air flow jet from the interior contour of the withdrawal tube 2 need not necessarily be taken out by the source of spinning suction, that is, through the suction line 13 by which in the rotor spinning apparatus (or a spinning apparatus of another design) a spinning suction is made available. It is also much more possible, that the side of the withdrawal tube 2 facing the spin rotor 10 when the rotor cover 3 is open is provided with another device for the production of a suction, by, for instance, although not shown, the installation of a venturi jet suction device on the appropriate end of the thread withdrawal tube 2. The suction from this device would pull the cleaning air as well as the loosened deposits out of the thread withdrawal tube 2 and appropriately remove them. It is very much required that the cleaning air flow for the thread withdrawal tube 2 is produced by means of the shown compressed air source 67. More likely, the suction action (spinning suction) which is present at the spin rotor 10, or the suction produced by a venturi jet, which jet is installed on the thread withdrawal tube 2 as above, would suffice to bring the desired air flows to the endangered places of the withdrawal tube 2. In this case, one or more of the air supply lines 6 and/or 60, either direct or indirect, could be placed in connection with ambient atmosphere around the open-end spinning apparatus.

This concept is valid for the cleaning of a spiral element 220 in accord with FIG. 2, even when the thread withdrawal tube 2 in the shown example embodiment shows two air supply lines 600 and 601, which are directed from a compressed air chamber 602 tangentially, that is, with a tangential component, into the interior of the thread withdrawal tube 2 . The compressed air chamber 602 is connected through the compressed air line 64 and the valve 66 to the compressed air source 67 (see FIG. 1).

The said compressed air chamber 602, if desired, can be extended over the entire length of the complete withdrawal tube 2 even into the area of the gap 24, so that the compressed air for the air supply lines 6 and 60, etc., reaches the thread withdrawal tube 2 through one and the same compressed air supply line 63.

In rotor cover 3, a connection recess boring 62 can be provided for the air supply for the air supply line 6 and/or 60, which recess 62 connects with the compressed air supply 63 or communicates with the atmosphere, in order, when required, to be connected with a compressed air supply line at some future time.

By means of the connection recess 62 holding the air supply line 61 which is interconnected with the air supply line 6, the above described cleaning conduit 68 can branch off for the cleaning of the spin rotor 10, unless another connection solution for the cleaning conduit 68 is desired.

In the embodiment example shown in FIG. 2, the spiral element 220 possesses one or more profiles 221 in the shape of webbed ribs, or the like, in order to build up a twist in thread 5. The profile 221 with one or more courses of profiles is designed as a spiral (that is to say, as a part of a spiral, which, in the concept of the present invention has been taken as equally effective).

So that the introduced air flow in the interior of the thread withdrawal tube 2 can clean this spiral element 220 in an optimal manner, in accord with the depicted embodiment in FIG. 2, the air entry against the spiral element 220 is made not only in a tangential direction, but the said air flow has a spiral orientation component which is essentially in continuation of the spiral element 220, so that the air flow is obliged to follow the profile channels in their entire length, or a sufficient longitudinal segment thereof, which leads to an effective cleaning of this irregular interior contour of the thread withdrawal tube 2.

Naturally, alternative air supply directions into the interior space of the thread withdrawal tube 2 are entirely possible if these alternatives, for whatever reason, seem necessary.

Where unusual design of the irregular interior contour of the thread withdrawal tube 2, or varying the suction equipment for the removal of loosened deposits is involved, such a deviating orientation of the air supply lines 6 and/or 60 can lead to special advantages even when, as a rule, the above described directing of the air flows for the cleaning of the thread withdrawal tube 2 can overcome these cleaning problems in the best way. For instance, by means of a radial inlet of a compressed air flow, the advantage can be achieved that stubborn deposits can be blown off, which deposits chronically form on especially endangered places of the interior 25 of the thread withdrawal tube 2. This is accomplished by a compressed air jet which strikes upon the said deposits in the interior 25 of the thread withdrawal tube 2 from the inside by crossing this interior space 25, or from the outside before reaching the interior. Otherwise, the loosened material from the interior contour of the thread withdrawal tube 2 and from that side of the said tube 2 which faces away from the open-end spinning apparatus is removed with the aid of a suction generating means installed on the said end of the thread withdrawal tube 2, in which case, a cleaning air flow oriented toward that side within the thread withdrawal tube 2 is advantageous.

If the spinning suction for the removal of loosened deposits is made use of, then the cleaning of the thread withdrawal tube 2 is carried out as well during possible interruption times of the spinning operation as well as in periodic time intervals, providing that for a lengthy time no interruption of this kind has occurred, for instance for a thread breakage correction or a batch exchange. In this matter, as has been often explained above, a cleaning of the thread withdrawal tube 2 can be carried out simultaneously with the rotor cleaning (or the cleaning of another type of open-end spinning equipment) or independently thereof, wherein in a rotor spin apparatus in the last case the rotor cover 3 is brought into its closed position, or, if it already finds itself in its closed position, is carried out in this closed position.

From the foregoing description may be inferred, that the execution of the described process may find application for a thread withdrawal tube 2 designed in a special way, or also, if necessary, for a specially designed rotor cover 3.

It will be apparent by those skilled in the art that various modifications and variations can be made in the present invention without departing from the scope and spirit of the invention. It is intended that the present invention include such modifications and variations as come within the scope of the appended claims and their equivalents.

Reference list of drawing numbers for 97/1024

"A process and an apparatus for the pneumatic cleaning of a thread withdrawal tube"

| | | | |
|---|---|---|---|
| 1 | Open-end spinning mach. | 4 | Drive apparatus |
| 10 | Spin rotor | 40 | Activation lever |
| 100 | Fiber collection groove | | |
| 101 | Base of spin bowl | 5 | Thread |
| 102 | Top edge of spin bowl | 50 | Incoming fibers |
| 11 | Rotating shaft for bowl | | |
| 12 | Housing for bowl | 6 | Compr. air inlet to bowl |
| 120 | Bottom of housing | 60 | Compr. air inlet to 25 |
| 121 | Detent for cover latch | 600 | Compr. air inlet to 220 |
| 122 | Connection opening | 601 | Compr. air inlet to 220 |
| 13 | Suction connection | 602 | Compr. air chamber |
| 14 | Suction source | 61 | Air inlet conduit |
| 15 | Valve in suction line | 62 | Connection recess |
| 16 | Drive | 63 | Compr. air line to 62 |
| 17 | Thread return device | 64 | Compr. air line to 60 |
| 170 | Thread discharge yoke | 65 | Compr. air feed line |

-continued

"A process and an apparatus for the pneumatic cleaning of a thread withdrawal tube"

| | | | |
|---|---|---|---|
| | | 66 | Compr. air valve |
| 2 | Thread withdrawing tube | 67 | Compr. air source |
| 20 | Inlet element of 2 | 68 | Cleaning conduit |
| 21 | Transition element of 2 | | |
| 210 | Chamfered nozzle of 21 | 7 | Control apparatus |
| 22 | Curved element in 2 | 70 | Control apparatus |
| 220 | Twist element | 700 | Control line |
| 221 | Interior profiles | 71 | Control apparatus |
| 23 | Thread discharge element | 710 | Control line |
| 24 | Gap | 72 | Control interconnection |
| 25 | Interior space in 2 | 73 | Control interconnection |
| | | 74 | Control interconnection |
| 3 | Rotor cap | 75 | Control line |
| 30 | Fiber feed conduit | 750 | Control line |
| 31 | Axis | | |
| 32 | Spring for 33 | b | Separation distance |
| 33 | Catch pawl | | |
| 330 | First end of 33 | | |
| 331 | Second end of 33 | | |
| 34 | Recessed space, recess | | |
| 35 | Shoulder on rotor cap | | |

What is claimed is:

1. A process for pneumatically cleaning a thread withdrawal tube of an open end spinning apparatus wherein the thread withdrawal tube comprises sequential axially aligned components that define an axial flowpath for suction air during normal spinning operations of the spinning apparatus and includes at least one inner contour consisting of one of a gap between the sequential axially aligned components of the thread withdrawal tube or a spiral rib configuration within the thread withdrawal tube wherein said contour is generally not within the axial flowpath of the suction air during normal spinning and thereby collects fiber and dirt deposits thereon, said process comprising directing a compressed airflow stream into the interior of the thread withdrawal tube at a location substantially opposite the contour and said compressed airflow stream crosses the axial flowpath of the suction air and is directed towards the inner contours to loosen fiber and dirt deposits therefrom.

2. The process as in claim 1, further comprising imparting a rotational component to the airflow stream.

3. The process as in claim 1, wherein said step of directing a compressed airflow stream comprises directing the airflow stream tangentially into the interior of the thread withdrawal tube with respect to the axial flowpath of the suction air.

4. The process as in claim 1, further comprising applying a suction force at an end of the thread withdrawal tube facing the open end spinning apparatus.

5. The process as in claim 4, wherein the thread withdrawal tube is disposed in a rotor cover covering a spin rotor which is subjected to a suction source in normal spinning operations, and comprising utilizing this normal spinning suction source as the suction force at the end of the thread withdrawal tube while the compressed airflow stream is directed into the thread withdrawal tube.

6. The process as in claim 5, further comprising opening the rotor cover from it normal spinning operation position and directing a high velocity air jet over an open rim of the spin rotor for cleaning the spin rotor while directing the compressed airflow stream through the thread withdrawal tube so that the compressed airflow stream enters the interior of the spin rotor.

7. The process as in claim 1, further comprising pulsating the compressed airflow stream directed into the thread withdrawal tube.

8. An apparatus for pneumatic cleaning of a thread withdrawal tube in an open end spinning device wherein said thread withdrawal tube is disposed in a rotor cover that seals against a rotor housing with a spin rotor disposed within the rotor housing, said apparatus comprising:

a thread withdrawal tube disposed in said rotor housing, said thread withdrawal tube further comprising sequential axially aligned thread guiding elements that define an axial flowpath for a thread and suction air during normal spinning operations of the spinning apparatus and includes at least one interior contour having one of a gap between said aligned thread guiding elements of said thread withdrawal tube or a spiraling section wherein said contour is generally not within the axial flowpath of the suction air during normal spinning and thereby collects fiber and dirt deposits thereon;

at least one air supply conduit defined in said rotor cover with an opening into said thread withdrawal tube; said opening disposed to direct a compressed air stream generally transverse to said axial flowpath and crosses said axial flowpath and is directed towards said interior contour; and a source of compressed air in pneumatic communication with said air supply conduit for controllably supplying high pressure air to said withdrawal tube for cleaning thereof.

9. The apparatus as in claim 8, wherein said interior contour comprises said spiraling section, said spiraling section comprising a spiraling rib component within said thread withdrawal tube.

10. The apparatus as in claim 9, wherein said, air supply conduit and said opening thereof are disposed and oriented to impart a rotational component to said compressed air stream directed against said spiraling section.

11. The apparatus as in claim 8, wherein said interior contour comprises said gap defined between sequentially disposed thread guiding elements, said thread guiding element defining one side of said gap furthest from said spin rotor comprising a chamfer surface against which said compressed air stream is directed.

12. The apparatus as in claim 8, further comprising a supply line with control valve in communication with said air supply conduit, and a control device configured with said control valve for variable controlling the supply of compressed air directed into said thread withdrawal tube.

13. The apparatus as in claim 12, further comprising a suction system in communication with said rotor housing for generating a suction force in an area of said spin rotor, said suction force being further applied at an end of said thread withdrawal tube facing said spin rotor, said control device in further communication with said suction system for coordinating delivery of compressed air delivered through said air supply conduit and suction at said end of thread withdrawal tube.

14. The apparatus as in claim 13, further comprising a drive mechanism for controllably moving said rotor cover relative to said rotor housing, said control device in further communication with said drive mechanism.

15. The apparatus as in claim 14, further comprising a pneumatic cleaning device for cleaning the spin rotor, said control device in further communication with said pneumatic cleaning device, wherein said control device coordinates and controls movement of said rotor cover away from said rotor housing and activation of said pneumatic cleaning device wherein a cleaning air stream is directed over an open rim of said spin rotor and said compressed air stream directed into said thread withdrawal tube enters said spin rotor directed against a base thereof.

16. The apparatus as in claim 12, wherein said control valve causes a pulsating air stream to be directed into said thread withdrawal tube.

* * * * *